United States Patent [19]

Skurkiss et al.

[11] 4,220,506

[45] Sep. 2, 1980

[54] PROCESS FOR PLATING SOLDER

[75] Inventors: Peter K. Skurkiss, Short Hills; Dennis R. Turner, Chatham Township, Morris County, both of N.J.

[73] Assignee: Bell Telephone Laboratories Incorporated, Murray Hill, N.J.

[21] Appl. No.: 968,619

[22] Filed: Dec. 11, 1978

[51] Int. Cl.[2] ..... C25D 7/06; C25D 17/12; C25D 17/28

[52] U.S. Cl. ..... 204/28; 204/206

[58] Field of Search ..... 204/15, 28, 224 R, 206

[56] References Cited

U.S. PATENT DOCUMENTS

| | | | |
|---|---|---|---|
| 1,864,490 | 6/1932 | Harrison | 204/208 |
| 3,554,878 | 1/1971 | Rothschild | 204/24 |
| 4,029,555 | 6/1977 | Tezuka | 204/15 |
| 4,153,523 | 5/1979 | Koontz | 204/15 |

*Primary Examiner*—T. M. Tufariello

*Attorney, Agent, or Firm*—Walter G. Nilsen

[57] ABSTRACT

An apparatus and process are described for plating tin-lead solder on metallic surfaces. Particularly significant is the high plating rate and the limited amount of plating in designated areas of the metallic surface. Solder is introduced into the plating solution from anode baskets holding tin-lead solder. This apparatus and process are particularly adaptable for continuous strip plating on metallic electrical connectors.

17 Claims, 3 Drawing Figures

PROCESS FOR PLATING SOLDER

TECHNICAL FIELD

The invention involves apparatus and process for electroplating lead-tin solder.

BACKGROUND OF THE INVENTION

Solder electroplating is used extensively in modern technology both as a protective coating and to render metallic surfaces solderable for various applications. Solder plating is highly advantageous principally because of low cost (as compared to gold electroplating, for example) and the need in many applications for a protective coating over various metals. Solder plating can also be done quite rapidly and can be used to cover large areas.

In modern technology, it is highly desirable to have high solder plating rates as well as high throughput of material. This is particularly true for electrical connectors which are used in large amounts in various electrical equipment. Particularly significant in recent years has been the development of continuous strip plating systems which have high material throughputs and relatively low economic investment. Such systems also have the advantage of reduced equipment necessary for venting and rinsing. Solder plating is discussed in some detail by B. F. Rothschild, in U.S. Pat. No. 3,554,878 issued Jan. 12, 1971.

SUMMARY OF THE INVENTION

The invention is apparatus and process for rapid electroplating of solder. The invention applies to tin-lead solder with 60±2 weight percent tin, remainder lead. This composition is nominally referred to as 60/40 tin-lead solder. Although impurities up to 5 weight percent are tolerable, higher purity levels are usually preferred (for example, up to one weight percent) for greater uniformity of properties and better protection of underlying metal. The apparatus is particularly adaptable to rapid plating, often in the range of 200–1,000 amperes per square foot. Best results in terms of plating quality and rapid production of plated material are obtained in the range of 300–400 amperes per square foot. The apparatus is quite useful in conjunction with other apparatus in a strip line plating system. Particularly unique is the fact that this apparatus design permits solder plating without excessive solder buildup on the upper and lower end of the piece being plated.

DETAILED DESCRIPTION

Figure 1:
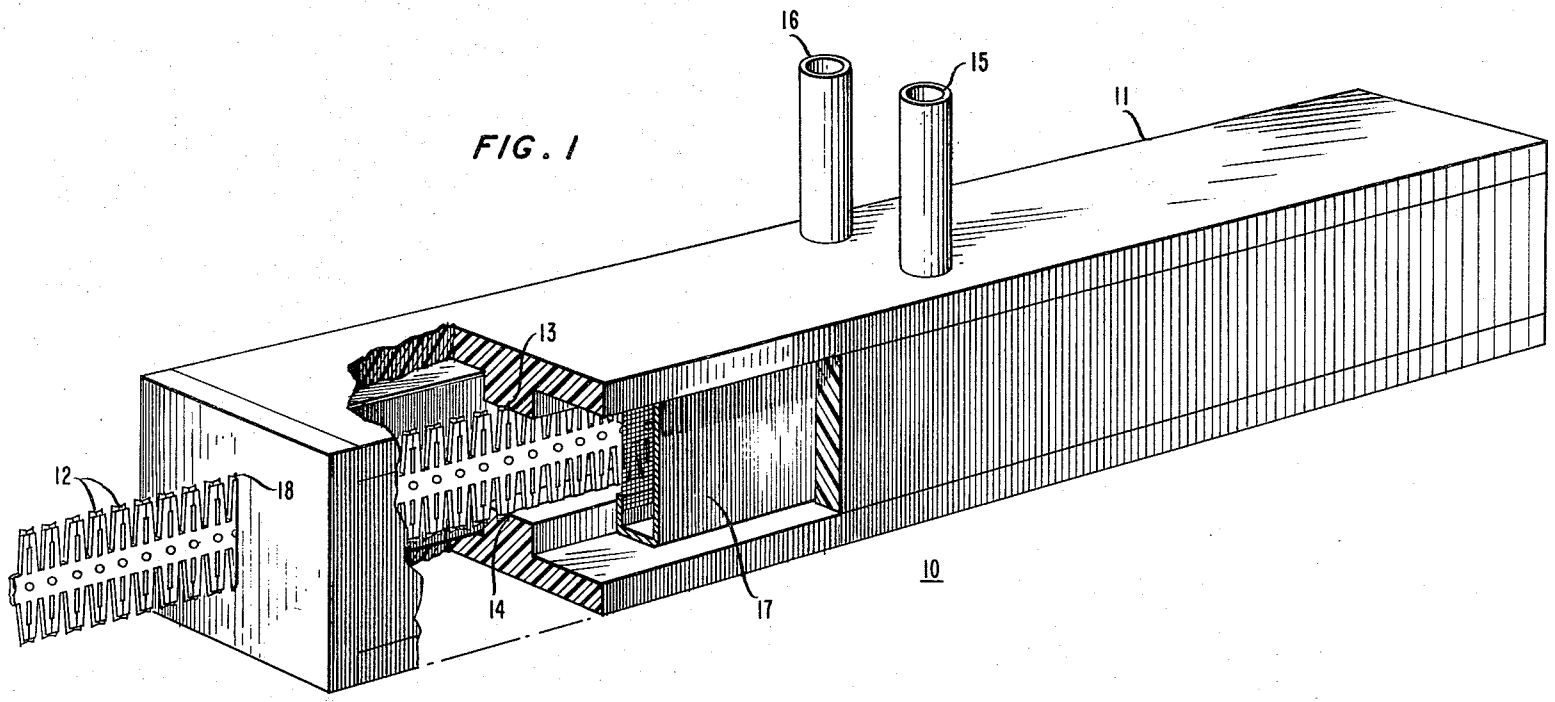
FIG. 1 shows a perspective view with cutaways of a solder plating cell.

In general terms, the invention is a solder plating cell and process uniquely suited for rapid solder plating in a strip line plating system. The plating cell is also shaped so as to prevent excessive solder buildup on the tips (top and bottom) of the piece being plated. The plating procedure and cell is particularly adaptable to plating electrical connector pieces and electrical contact pieces because of the quantity used and the advantage in using 60/40 tin-lead solder in electrical applications.

The plating cell is best described as a closed or semi-closed system, with input and output ports to circulate plating solution. The strip to be plated moves down the center of the cell guided by slots or grooves on top and bottom which also prevent excessive buildup of solder on top and bottom of the piece being plated. Electrical contact is made to the strip being plated generally using brushes or rollers. This arrangement electrically connects the strip to a power supply so as to make the strip to be plated the cathode in the plating cell.

The anode is made up of a metal basket located on either one or both sides of the metal strip being plated and extending along the length of the cell. The basket contains pieces of 60/40 tin-lead solder which dissolve (are electrolytically oxidized) during the electroplating process. Such dissolution of solder replenishes the tin and lead in the solder plating bath. Although pure tin metal or pure lead metal may be put into the anode basket, this procedure would change the composition (tin/lead ratio) of the bath. The metal basket may be made up of any inert conducting material. Certain copper-nickel alloys such as monel are ideal, particularly when a fluoroboric acid plating solution is used. The metal basket is electrically connected to one end of the power supply so as to make it the anode of the plating cell.

Various plating solutions may be used in the plating procedure. Solder plating solutions are described by B. F. Rothschild, in U.S. Pat. No. 3,554,878 issued Jan. 12, 1971. A typical plating solution is set forth in the table below:

*Concentration in grams/liter*

| | *Range* | *Optimum* |
|---|---|---|
| Stannous tin | 12–20 | 15±2 |
| Lead | 8–14 | 10±1 |
| Free fluoboric acid | 350–500 | 400±20 |
| Temperature | 60–100 F | 74 F±5 F |

The range of concentration in the "optimum" column reflects either the accuracy with which the optimum concentration and temperature can be determined or the accuracy with which the concentration and temperature can be controlled. This solder plating solution is particularly advantageous for strip line plating because of high plating rates permitted. Particularly advantageous is a plating rate between 200 and 1,000 amperes per square foot. Higher plating rates may be used but the quality of the plating may occasionally be affected. Lower plating rates yield excellent results but are not as advantageous economically because of slower throughput.

This plating solution is also advantageous because it plates out 60/40 tin-lead solder. Nominally, 60/40 tin-lead solder has approximately 60±2 weight percent tin, remainder lead. This composition is highly desirable for several reasons. It is the eutectic point for tin-lead. This makes it ideal for soldering. The 60/40 tin-lead solder is also quite hard and, therefore, has excellent wear qualities. Excellent wear qualities are particularly advantageous for electrical connectors, electrical contact, etc. because it leads to long lifetimes.

An understanding of the invention is facilitated by a description of the drawing. FIG. 1 shows a view in perspective of the solder plating cell 10. The solder plating cell is made up of an electroplating container 11. The electroplating container is made of an inert material usually a plastic preferably a clear plastic such as plexiglass. The strip to be plated 12 moves down the center of the plating cell along the long dimension in a channel.

The strip is held in position in the channel by small notches or grooves on top 13 and bottom 14 of the channel path of the metal strip. Solder plating solution is circulated through the plating cell by means of an input tube 15 and output tube 16. The role of input and output tubes may be reversed. The anode 17 is located on both sides of the metal strip and along the length of the solder plating cell. Some screening is required in the structure of the anode to permit circulation of plating solution into the anode structure where the tin-lead solder is located. The anode basket may be made of all screening but the particular model shown here only has screening on the side of the anode facing the strip being plated. The metal strip 12 enters the cell through a long narrow slot 18 and exits the cell through a similar slot not shown.

Figure 2:
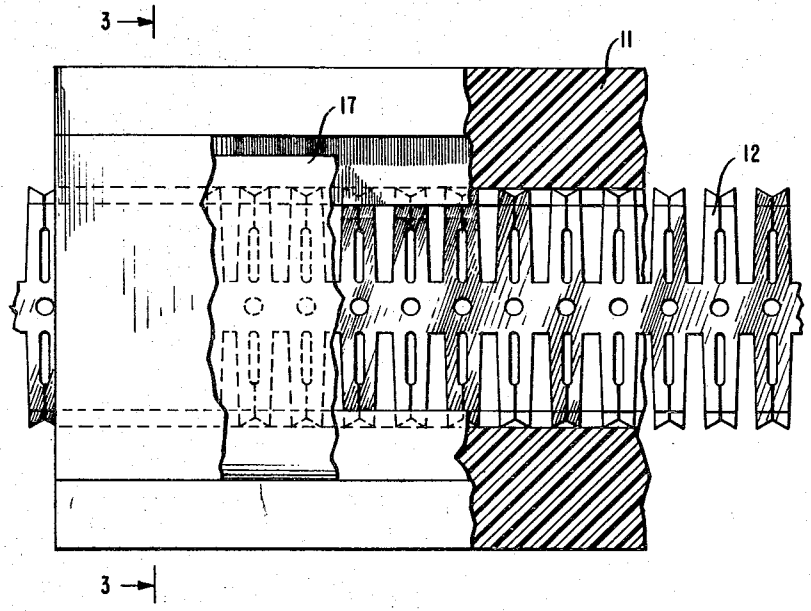
FIG. 2 shows a cross-section view along the length of the solder plating cells.

FIG. 2 shows a sectioned view of the plating cell. The section is along the length of the cell and shows metal strip 12, the anode 17 and container walls 11.

Figure 3:
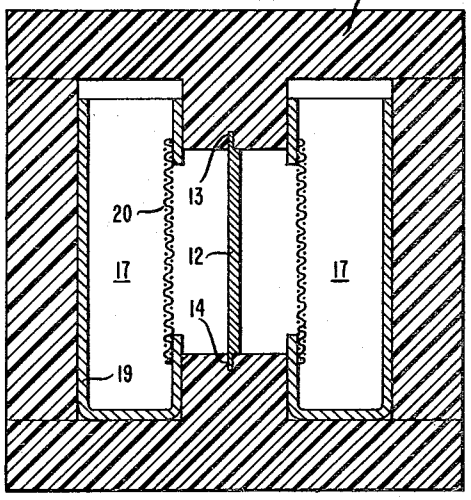
FIG.3 shows a cross-section view across the width of the solder plating cell.

FIG. 3 shows a sectioned view perpendicular to the length of the plating cell. The metal strip 12 is shown together with the upper slot 13 and the lower slot 14. Also shown is the inert container walls 11, and anode 17. The anode is made up of solid inert metal 19, and a metal screening 20 which permits plating solution to circulate inside the anode basket.

A particular advantage of the solder plating cell is its adaptability for use in a multicell strip line plating apparatus. Such an apparatus generally includes cleaning cells, rinsing cells, acid dipping cells and drying apparatus. A typical strip line for solder plating has a cleaning cell, a rinsing cell, an acid dipping cell, another rinse cell, a solder plating cell, a third rinse cell, and a drying cell. Generally, this strip line or metal strip to be plated is pulled through all of these cells which are aligned one after the other.

The nature of the cleaning cell generally depends on the contaminate to be removed from the surface of the strip being plated. If this is an oil or grease from a cutting machine, as is usually the case, an alkaline detergent is usually used. A typical alkaline detergent is alconox. Electrolytic cleaning in which the strip is either cathode or anode may be used.

The cleaning cell is followed by a rinse cell generally made up of a water spraying apparatus that washes off solution from the previous electrochemical cell.

This cell is followed by an acid dip cell generally used to remove oxide from the metal surface. The nature of the acid depends on the composition of the metal strip. For copper containing metal strips, a mixture of nitric acid and sulfuric acid is usually used. For nickel containing metal strips, fluoboric acid or mixture of fluoboric acid and sulfuric acid is often used. The dipping cell is followed by a rinse cell and subsequently followed by a solder plating cell. A rinse cell is then used to remove solder plating solution. The metal strip is dried generally by blowing nitrogen or dry onto the metal strip.

Highly advantageous is a process for making electrical connectors from pins plated in the solder plating cell described above. Solder plating on such pins yields excellent protection. The pin surfaces are easily solderable and exhibit good electrical contact to other surfaces. An additional important advantage is the low cost of the process and the speed with which such pins can be solder plated. In addition, continuous strips of the pins may be processed either through the solder plating cell alone, or the entire array of electrochemical cells referred to above as the strip line plating apparatus. Particularly advantageous is immediate sequential processing since surfaces are not contaminated between processing steps, and large amounts of inventory need not be built up between processing steps. Further, pins are rapidly produced with high yield and low cost. Initial capital costs are generally low and it is particularly convenient for real time control, including pH measurement, temperature control, etc.

We claim:

1. An apparatus for electrodeposition of nominally 60/40 tin-lead solder onto a metallic strip comprising (a) an electroplating container;

(b) a first slotted section for admitting metal strip into the electroplating container, said slotted section being high enough and wide enough to provide clearance for the metallic strip;

(c) means for electrical contact to said metal strip;

(d) a channel for the metallic strip located inside the electroplating container and running from the first slotted section to a second slotted section comprising a groove on top and a groove on the bottom of said container in which the metallic strip is guided through the container;

(e) an anode on at least one side of the channel for the metal strip and parallel to said channel for the metal strip comprising a basket to hold active anode material, said basket at least partially open to permit circulation of plating solution inside the basket and in which the basket comprises a conducting material inert to said plating solution, where said conducting material consists essentially of monel and said active anode material consists essentially of nominally 60/40 tin-lead solder;

(f) electrical means of connecting the anode to a power supply;

(g) an input and output tube to circulate solder plating solution in the electroplating container;

(h) a second slotted section to permit said metal strip to exit the electroplating cell, said slotted section being high enough and wide enough to provide clearance for the metallic strip.

2. The apparatus of claim 1 in which the metal strip to be plated comprises connector pins for electrical connectors.

3. The apparatus of claim 1 in which the means for electrical contact to the metal strip are rollers in electrical contact with said metal strip.

4. The apparatus of claim 1 in which the means for electrical contact to the metal strip are brushes in electrical contact with said metal strip.

5. The apparatus of claim 1 in which the electroplating container comprises a plastic.

6. The apparatus of claim 1 in which the groove on top and groove on the bottom of the channel is shaped to partially mask the top and bottom of the strip to be plated to prevent overplating.

7. A process for plating nominally 60/40 tin-lead solder onto a continuous metallic strip comprising the step of introducing the metal strip into an apparatus, said apparatus comprising (a) an electroplating container;

(b) a first slotted section for admitting metal strip into the electroplating container, said slotted section being high enough and wide enough to provide clearance for the metallic strip;

(c) means for electrical contact to said metal strip;

(d) a channel for the metallic strip located inside the electroplating container and running from the first slotted section to a second slotted section comprising a groove on top and a groove on the bottom of said container in which the metallic strip is guided through the container;

(e) an anode on at least one side of the channel provided for the metal strip and parallel to said channel provided for the metal strip comprising a basket to hold active anode material, said basket at least partially open to permit circulation of plating solution inside the basket and in which the basket comprises a conducting material inert to said plating solution, where said conducting material consists essentially of monel and said active anode material consists essentially of nominally 60/40 tin-lead solder;

(f) electrical means of connecting the anode to a power supply;

(g) an input and output tube to circulate solder plating solution in the electroplating container;

(h) a second slotted section to permit said metal strip to exit the electroplating cell, said slotted section being high enough and wide enough to provide clearance for the metallic strip.

8. The process of claim 7 in which the plating rate is between 200 and 1,000 amperes per square foot.

9. The process of claim 8 in which the plating rate is between 300 and 400 amperes per square foot.

10. The process of claim 7 in which the metal strip to be plated comprises connector pins for an electrical connector.

11. The process of claim 7 in which the plating solution comprises stannous tin 12–20 grams/liter; lead 8–14 grams/liter; free fluoboric acid 350–500 grams/liter; and the remainder water.

12. The process of claim 11 in which the plating solution comprises stannous tin 15±2 grams/liter; lead 10±1 grams/liter; free fluoboric acid 400±20 grams/-liter.

13. The process of claim 9 in which the plating procedure is carried out at a temperature between 60 and 100 F.

14. The process of claim 13 in which the plating procedure is carried out at a temperature of 75±5 F.

15. The process of claim 9 in which the apparatus for continuous electrodeposition is proceeded by a cleaning cell, a first rinsing cell, acid dipping cell, a second rinsing cell.

16. The process of claim 15 in which the apparatus for continuous electrodeposition is succeeded by a rinsing cell and a drying cell.

17. The process of claim 7 in which grooves on top and bottom of the channel are used to partially mask the top and bottom of the strip being plated to prevent overplating on top and bottom of the strip being plated.

* * * * *